United States Patent [19]

Yoshida

[11] 4,090,482

[45] May 23, 1978

[54] EXHAUST GAS RECIRCULATION APPARATUS FOR AN INTERNAL COMBUSTION ENGINE

[75] Inventor: Masakazu Yoshida, Toyota, Japan

[73] Assignee: Toyota Jidosha Kogyo Kabushiki Kaisha, Toyota, Japan

[21] Appl. No.: 739,010

[22] Filed: Nov. 4, 1976

[30] Foreign Application Priority Data

Aug. 5, 1976 Japan ..... 51-10397[U]

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,812,832 | 5/1974 | Scott | 123/119 A |
| 3,834,366 | 9/1974 | Kingsbury | 123/119 A |
| 3,915,133 | 10/1975 | Nohira | 123/119 A |
| 3,994,269 | 11/1976 | Takaoka et al. | 123/119 A |

*Primary Examiner*—Wendell E. Burns

*Attorney, Agent, or Firm*—Stevens, Davis, Miller & Mosher

[57] ABSTRACT

An exhaust gas recirculation apparatus for an internal combustion engine, provided with a vacuum-operated EGR valve having a diaphragm which forms a vacuum control chamber on one side of the diaphragm, which chamber is connected to a vacuum port formed in the engine intake system for transmitting a vacuum signal to the chamber in order to operate the EGR valve for controlling the amount of exhaust gas to be recirculated. The apparatus is further provided with a temperature detecting valve adapted for introducing a limited amount of air through an orifice when the engine is operating under a warm-up condition during which the temperature of the engine is not yet sufficiently increased, so that the amount of the gas recirculated during such an operation is decreased to some extent. The amount of the emission of $NO_x$ component is slightly increased whereas the amounts of the emissions of CO and HC components are decreased. Therefore, the amounts of the emissions of the three major toxic components $NO_x$, CO and HC are equalized.

3 Claims, 3 Drawing Figures

EXHAUST GAS RECIRCULATION APPARATUS FOR AN INTERNAL COMBUSTION ENGINE

FIELD OF THE INVENTION

The present invention relates to an exhaust gas recirculation apparatus for an internal combustion engine, which is particularly suitable for use in a heavyweight vehicle, for example, a truck.

BACKGROUND OF THE INVENTION

In order to decrease the amount of the emission of nitrogen oxide ($NO_x$) component in an internal combustion engine, an exhaust gas recirculation (EGR) apparatus is used. In this apparatus, a part of the exhaust gas is recirculated from the engine exhaust system to the engine intake system in order to decrease the combustion temperature so that the amount of $NO_x$ component in the resultant exhaust gas is reduced.

If the EGR operation is carried out when the engine is operating under a warm-up condition in which the temperature of the engine has not yet sufficiently increased, an adverse effect will inevitably occur thus preventing a proper engine operation. Therefore, for a vehicle of a relatively light weight, it is preferable to provide means for stopping the EGR operation when the engine is operating under a warm-up condition.

However, when the EGR apparatus is utilized in a heavyweight vehicle such as a truck, the EGR operation should not be completely stopped during the warm-up condition. Because, if the EGR operation is not carried out, a large amount of $NO_x$ is exhausted from the heavyweight vehicle, which excessive amount is not allowed by the present strict legal restriction limiting the amount of toxic components that can be emitted from an engine.

However, if an EGR operation exhibiting a large EGR ratio is carried out during the warm-up condition, it is necessary to step very hard on the accelerator pedal in order to obtain a large throttle opening for achieving a sufficient output power. This is because during the warm-up operation as well as during the EGR operation, a relatively large amount of fuel is required for operating the engine. Due to the large throttle opening, the amount of intake gas sucked into the engine becomes very large, therefore, large amounts of hydrocarbon (HC) and carbon monoxide (CO) components remain in the exhaust gas. These toxic components cannot be effectively cleaned by a catalytic converter arranged in the exhaust pipe, because in this warm-up condition the temperature of the exhaust gas cannot reach the proper temperature at which an effective cleaning operation of the CO and HC components performed by the catalytic converter can be obtained.

SUMMARY OF THE INVENTION

An object of the present invention is to provide an exhaust gas recirculation apparatus, which is particularly suitable for use in a heavyweight vehicle.

Another object of the present invention is to provide an exhaust gas recirculation apparatus, in which a limited amount of exhaust gas is recirculated during the engine warm-up condition for reducing the amount of CO and HC emissions although the amount of $NO_x$ emission is slightly increased by such a recirculation.

Still another object of the invention is to provide an exhaust gas recirculation apparatus, in which the amounts of the three major toxic components emitted during the warm-up condition can be equalized.

According to the invention to attain these objects, an exhaust gas recirculation apparatus for an internal combustion engine is proposed, which apparatus is provided with vacuum-operated flow control valve means arranged on exhaust gas recirculation pipe means connecting the exhaust system of the engine with the intake system of the engine, the flow control valve means being provided with vacuum-operated means connected to a port formed in the exhaust system through vacuum signal pipe means for controlling the amount of exhaust gas recirculated from the exhaust system to the intake system through the vacuum signal pipe means in accordance with the level of the vacuum pressure at the port.

The apparatus further comprises: air control pipe means connecting the vacuum signal pipe means with the atmosphere; orifice means formed in the air control pipe means for controlling the amount of air passed through the air control pipe means; and temperature detecting valve means arranged in said air control pipe means, which operate to open the air control pipe means when the temperature of the engine has not yet fully increased, so that a limited amount of air is introduced into the vacuum signal pipe means through the orifice means in order to cause a limited level of vacuum signal to be transmitted to the vacuum-operated means. As a result of this, a limited amount of the exhaust gas is recirculated during said engine warm-up operation, so that amounts of the CO and HC emissions are reduced although the amount of the $NO_x$ emission is slightly increased.

DETAILED DESCRIPTION OF THE PREFERRED EMBODIMENT

Figure 1:
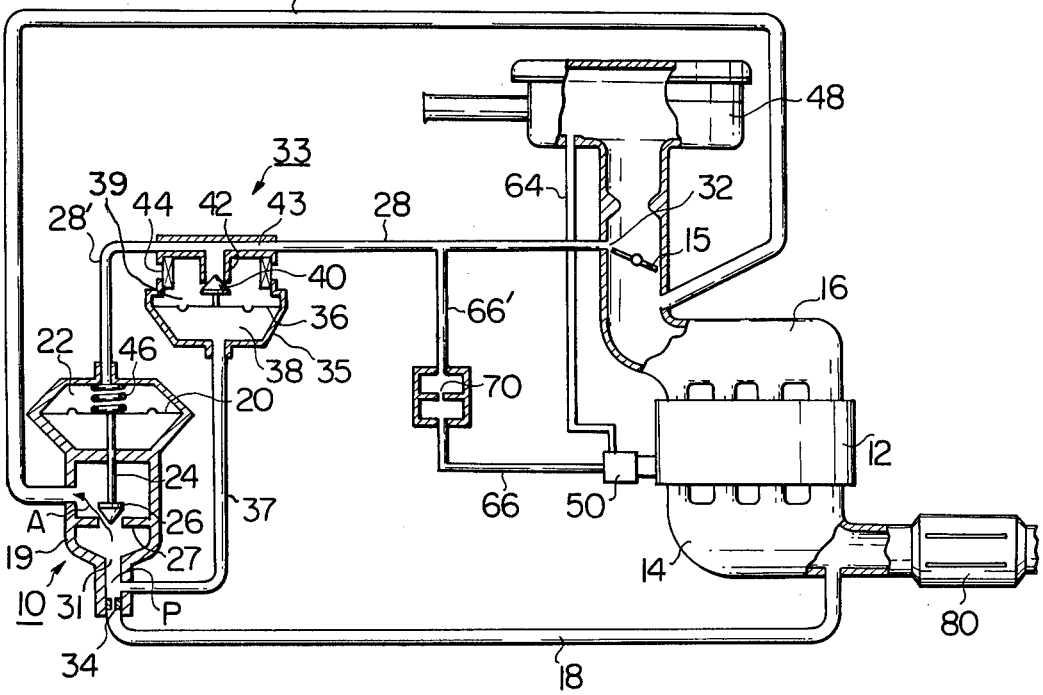
FIG. 1 is a diagrammatical view of an exhaust gas recirculation apparatus according to the invention.

In the drawings, there is shown a so-called back pressure control type exhaust gas recirculation apparatus, in which type a constant recirculated gas proportion is obtained by keeping a constant exhaust gas pressure in the exhaust gas recirculating passageway. Good results can be expected when applying this type of EGR apparatus to the present invention as will be described later. In FIG. 1, numeral 10 is a flow control valve (a so-called EGR valve) arranged between the exhaust gas recirculation pipes 18 and 18' which connect an exhaust manifold 14 of an internal combustion engine 12 with an intake manifold. The intake manifold 16 is 16 located between an air cleaner 48 and a throttle valve 15. The valve 10 controls the amount of the exhaust gas which is recirculated through the EGR pipes 18 and 18'. The EGR valve 10 includes a casing 19 and a diaphragm 20 arranged across the interior of the casing 19 so as to form a vacuum control chamber 22 on an upper side of the diaphragm 20. The diaphragm 20 is connected to a valve member 26 via a rod 24 which is slidably supported on the casing 19. The valve member 26 which is urged downwardly by a spring 46 in the valve control member 22 is arranged so as to face a valve seat 27 formed in the casing 19, in order to control the amount of exhaust gas passed through the valve seat 27 in accordance with the vacuum level of the vacuum control chamber 22. The vacuum control chamber 27 is connected, via the vacuum signal pipes 28 and 28', to a port 32 (a so-called EGR port) located slightly above the fully closed throttle valve 15.

Numeral 33 designates a pressure control valve adapted for keeping a constant pressure P in a passageway 31 formed in the casing 19 between the valve seat 27 and an orifice 34 formed in the passageway 31. The pressure control valve 33 includes a casing 35 and a diaphragm 36 arranged across the interior of the casing 35 so as to form an exhaust gas pressure control chamber 38 on the lower side of the diaphragm 36 which is connected to the passageway 31 between the valve seat 27 and the orifice 34 through an exhaust gas pressure signal pipe 37. A chamber 39 opened to the atmosphere though an annular filter element 44 is formed on an upper side of the diaphragm 36. The chamber 39 is connected to a passageway 43 formed in the casing 35 (which passageway 43 is connected to the vacuum signal pipes 28 and 28') through a valve seat 42. The valve seat 42 is opened or closed by a valve member 40 connected to the diaphragm 36.

The pressure control valve 33 operates to keep a constant pressure P of the exhaust gas in the passageway 31. This is because (1) when the pressure of the exhaust gas becomes larger than P due to a small amount of exhaust gas being recirculated through the passageway 31, the diaphragm 36 of the valve 33 is moved upwardly by a large exhaust gas pressure signal transmitted from the passageway 31 to the exhaust gas pressure control chamber 38 through the exhaust gas pressure signal pipe 37 so as to cause the valve seat 42 to be closed by the valve member 40 to close the passageway 43 to the atmosphere, so that the full level of the vacuum signal formed at the EGR port 32 located downstream of the throttle valve 15 (which is open) can be transmitted to the vacuum control chamber 22 of the EGR valve 10 though the vacuum signal pipe 28, the passageway 43, and the vacuum signal pipe 28' in order to move the diaphragm 20 upwardly and to move the valve member 26 away from the valve seat 27, causing the amount of exhaust gas recirculated through the passageway 31 (as shown by an arrow A) to be increased so that the pressure of the exhaust gas at the passageway 31 which was larger than P is decreased toward P; (2) when the pressure of the exhaust gas becomes smaller than P due to a large amount of exhaust gas being recirculated through the passageway 31, the diaphragm 36 of the control pressure valve 33 is moved downwardly by a small exhaust gas pressure signal transmitted from the passageway 31 to the exhaust gas pressure control chamber 38 through the exhaust gas pressure signal pipe 37 so as to cause the valve seat 42 to be opened to the atmosphere through the chamber 39 and the annular filter element 44, so that the level of vacuum signal formed at the EGR port 32 which is transmitted to the vacuum control chamber 22 of the EGR valve 10 via the vacuum signal pipes 28 and 28' is reduced in order to move the diaphragm 20 downwardly and to move the valve member 26 toward the valve seat 27, causing the amount of the exhaust gas recirculated through the passageway 31 (as shown by the arrow A) to be decreased so that the pressure of the exhaust gas at the passageway 31 which was smaller than P is increased toward P.

By this operation of the pressure control valve for controlling the constant exhaust gas pressure P, it is expected that a constant recirculated gas proportion be maintained regardless of the degree of the throttle opening.

However, when this apparatus is utilized in a heavyweight vehicle, it is necessary, as described before to decrease the amount of the EGR to some extent when the vehicle is operating under a warm-up condition in which the temperature of the engine has not yet fully increased in order to bring about an effective elimination-operation of the toxic components from an internal combustion engine and in which the amounts of emissions of the three major toxic components $NO_x$, CO and HC are equalized.

Figure 2:
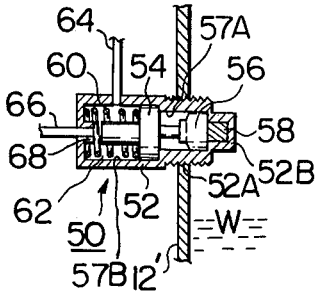
FIG. 2 is a cross-sectional view of the temperature detecting valve shown in FIG. 1, which valve is in its "ON" position.

According to the present invention, the apparatus further includes a temperature detecting valve 50 adapted for opening the vacuum signal pipe 28 with the atmosphere when the engine 12 is operating under a warm-up condition. In this embodiment the temperature detecting valve 50 includes, as shown in FIG. 2, a casing 52 having a thread portion 52A screwed and secured to an outer wall 12' of the engine 12 (FIG. 1) and having an end portion 52B arranged so as to come into contact with engine cooling water W stored in a space formed in the engine. The temperature detecting valve 50 also has a piston member 56 slidably accommodated in a cylinder bore 57A of a smaller diameter formed in the casing 52, a valve member 54 slidably accommodated in a cylinder bore 57B of a larger diameter, a thermo-wax material 58 accommodated in the casing 52 at the end portion 52B, and a spring 60 urging the valve member 54 so as to cause the member 54 to be detached from a valve seat 68. A chamber 62 formed in the casing 52 communicates with a pipe 64 which is, as shown in FIG. 1, connected to the air cleaner 48. The valve seat 68 capable of being connected to the chamber 62 communicates with a pipe 66, which is, as shown in FIG. 1, connected to the vacuum pressure signal pipe 28 through an orifice 70 and a pipe 66' also shown in FIG. 1.

Figure 3:
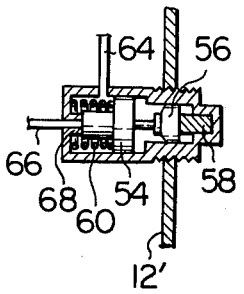
FIG. 3 is a cross-sectional view similar to that in FIG. 2 except that the temperature detecting valve is in its "OFF" position.

The thermo-wax material 58 contracts (as shown in FIG. 2) when the temperature of the cooling water W is lower than a predetermined temperature, for example, 40° C, so that the temperature detecting valve 50 is in its "ON" position in which the spring 60 urges the valve member 54 toward the engine's outer wall 12' so as to cause the valve member 54 to be detached from the valve seat 68 in order to communicate the pipe 66 with the pipe 64 through the chamber 62. The thermo-wax material 58, however, expands (as shown in FIG. 3) when the temperature of the cooling water W increases higher than the predetermined temperature so that the valve 50 is switched to the "OFF" position in which the thermo-wax material 58 urges the piston member 56 allowing the valve member 54 to be moved away from the wall 12' and against the spring 60, so that the valve member 54 is rested on the valve seat 68 in order to prevent communication between the pipes 66 and 64.

As shown in FIG. 1 an orifice 70 is provided between the pipes 66 and 66' for controlling the amount of air introduced into the vacuum signal pipe 28 when the temperature detecting valve 50 is in its "ON" position. The determining of the dimension of the orifice 70 will be described later.

OPERATION

When a sufficient period of time has not yet elapsed from the starting of the engine (in other words when the engine is operating under a warm-up condition), the temperature of the cooling water W is not increased to the predetermined temperature so that the material 58 contracts as shown in FIG. 2, allowing communication between the pipes 64 and 66. As a result of this, air in the air cleaner 48 is introduced into the vacuum signal pipe 28 via the pipe 64, the chamber 62 of the temperature detecting valve 50, the valve seat 68, the pipe 66, the orifice 70 and the pipe 66'. In this case, the amount of air thus introduced into the vacuum pipe 28 is determined by the dimension of the orifice 70. As a result of the introduction of a limited amount of air into the vacuum signal pipe 28, the vacuum level at the vacuum control chamber 22 of the EGR valve 10 connected to the vacuum port 32 via the vacuum signal pipe 28, the passageway 43 and the pipe 28' is decreased to some extent, and thus the diaphragm 20 in moved so as to cause the valve member 26 to be moved toward the valve seat 27 for a limited distance. As a result of this limited movement of the valve member 26 toward the valve seat 27, the amount of the recirculated exhaust gas which is passed between the valve member 26 and the valve seat 27 is decreased to some extent. The amount of the decreased exhaust gas is determined by the dimension of the orifice 70. That is to say, when the dimension of the orifice 70 is enlarged, the vacuum level in the chamber 22 drops enough to cause, the amount of the recirculated exhaust gas to be greatly decreased.

As a result of the limited amount of the recirculated exhaust gas present during the engine warm-up condition, a sufficient output power is obtained by utilizing a relatively small throttle opening. Thus the amount of intake air passed through the throttle valve 15 is prevented from being strictly increased in volume. Therefore, the amount of CO and HC components in the exhaust gas, which are passed throught the catalytic converter 80 (FIG. 1) without being cleaned durig this warm-up operation because of the low temperature of the exhaust gas occurring during this condition, is prevented from being increased.

As is clear from the above-mentioned operation, since the EGR operation with the limited EGR ratio is carried out during the warm-up condition due to the introduction of air via the orifice 70 into the vacuum signal pipe 28, the amount of the $NO_x$ component in the exhaust gas is increased to some extent. However, the amounts of CO and HC emissions are effectively reduced due to the relatively small throttle opening. Thus, the amounts of the emissions of the three toxic components $NO_x$, CO and HC are equalized.

When a sufficient period of time has elapsed from the starting of the engine (in other words when the temperature of the engine is fully increased), the thermowax 58 expands (as shown in FIG. 3) because the temperature of the engine cooling water W increases higher than the predetermined temperature so that the valve number 54 is rested on the valve seat 68 against the spring 60, so as to cause the valve seat 68 and the pipe 66 to be closed. As a result of this, the full vacuum signal level at the EGR port 32 can now be transmitted to the vacuum control chamber 22 of the EGR valve 10. Therefore, a sufficient amount of the exhaust gas can be recirculated in order to decrease the amount of the $NO_x$ emission. In this operation, since the temperature of the exhaust gas is fully increase, the catalytic converter 80 can then effectively reduce the amounts of the CO and HC emissions.

This invention can be applied to various types of the EGR system. However, if this invention is applied only to the EGR system which is provided with a pressure control valve 33 substantially good results can be obtained. Because, in this pressure-control type EGR system, the vacuum level in the vacuum control chamber 22 of the EGR valve is kept within a restricted and narrow range due to the opening and closeing operation of the pressure control valve 33 by the pressure of the exhaust gas. That is to say, the control of the vacuum level for limiting the amount of the recirculated exhaust gas by the introduction of the restricted amount of air through the orifice 70 can be easily carried out.

In the embodiment shown in FIGS. 1, 2 and 3 the introduction of air into the vacuum signal pipe 28 is controlled by the temperature detecting valve 50 provided with the thermowax 58 for detecting the engine warm-up condition. However, other suitable means may be utilized for detecting such engine warm-up conditions.

What is claimed is:

1. Apparatus for controlling the emission of noxious gases from an internal combustion engine comprising, an intake conduit having a throttle valve therein and exhaust conduit, a catalytic converter in said exhaust conduit, a conduit for recirculating exhaust gases from said exhaust conduit upstream of said converter to said intake conduit downstream of said throttle valve, a normally closed valve controlling flow through said recirculation conduit, means responsive to vacuum upstream of the closed position of said throttle to open said flow controlling valve, means responsive to increases in exhaust gas pressure from a predetermined level to increase the effect of said vacuum responsive means and means responsive to an engine operating temperature below a predetermined value for reducing the effect of said vacuum responsive means.

2. Apparatus as claimed in claim 1, further comprising adjustable means to introduce air into the means responsive to vacuum upstream of the closed position of said throttle valve and means responsive to pressure in said recirculation circuit to control the adjustment of said air introducing means.

3. Apparatus according to claim 1, wherein said means responsive to engine operating temperature comprises:

a casing secured to an engine outer wall, a valve seat formed in said casing and arranged on said air control pipe means, a valve member capable of seating on said valve seat, and a thermowax material packed in the casing in order to sense the temperature of the engine cooling water, said thermowax member being contracts when said temperature of the engine cooling water is lower than a predetermined temperature to cause said valve member to be detached from said valve seat, said thermowax member expands when said temperature of the engine cooling water is higher than said predetermined temperature to cause said valve member to be rested on said valve seat.

* * * * *